US011270633B1

(12) United States Patent
Wei et al.

(10) Patent No.: US 11,270,633 B1
(45) Date of Patent: Mar. 8, 2022

(54) SKEWING DRIVE TIMES OF LED ZONES IN A DISPLAY DEVICE WITH DISTRIBUTED DRIVER CIRCUITS

(71) Applicant: Huayuan Semiconductor (Shenzhen) Limited Company, Shenzhen (CN)

(72) Inventors: Chih-Chang Wei, Taoyuan (TW); Junjie Zheng, Cupertino, CA (US); Richard Landry Gray, Taipei (TW)

(73) Assignee: Huayuan Semiconductor (Shenzhen) Limited Company, Shenzhen (CN)

( * ) Notice: Subject to any disclaimer, the term of this patent is extended or adjusted under 35 U.S.C. 154(b) by 0 days.

(21) Appl. No.: 17/125,803

(22) Filed: Dec. 17, 2020

(51) Int. Cl.
*G09G 3/32* (2016.01)

(52) U.S. Cl.
CPC ..... *G09G 3/32* (2013.01); *G09G 2310/08* (2013.01)

(58) Field of Classification Search
CPC ..... G09G 2310/08; G09G 3/32
See application file for complete search history.

(56) References Cited

U.S. PATENT DOCUMENTS

2011/0279486 A1* 11/2011 Kang ..... G09G 3/3406 345/690
2013/0015770 A1* 1/2013 Aitken ..... G09G 3/3406 315/154
2016/0093248 A1* 3/2016 Shimizu ..... G09G 3/3233 345/691
2021/0045212 A1* 2/2021 Lai ..... H05B 45/10

* cited by examiner

*Primary Examiner* — Muhammad N Edun
(74) *Attorney, Agent, or Firm* — Fenwick & West LLP

(57) ABSTRACT

A display device comprises an array of light emitting diode zones in a display area. The display device further comprises a control circuit to generate dimming signals to control respective duty cycles for driving the light emitting diode zones during a frame. The display device further comprises an array of driver circuits distributed in the display area of the display device. Each of the driver circuits receives the respective duty cycle for the frame at a first time and receives an update signal at a second time. Each driver circuit drives one of the light emitting diode zones according to the respective duty cycles of the dimming signals in response to the update signal. Different groups of driver circuits start driving the respective light emitting diode zones at different respective offset times during the frame.

20 Claims, 15 Drawing Sheets

SKEWING DRIVE TIMES OF LED ZONES IN A DISPLAY DEVICE WITH DISTRIBUTED DRIVER CIRCUITS

BACKGROUND

This disclosure relates generally to driving light emitting diodes (LEDs) of a display device, and more specifically to controlling skew of LED zone driving times in the display device with distributed driver circuits.

LEDs are used in many electronic display devices, such as televisions, computer monitors, laptop computers, tablets, smartphones, projection systems, and head-mounted devices. Modern displays may include very large numbers of individual LEDs that may be arranged in rows and columns in a display area. In order to drive each LED, a power supply supplying current to all of the LEDs must meet challenging transient response requirements.

SUMMARY

Embodiments relate to a display device that drives light emitting diode (LED) zones according to a skewed pulse width modulation (PWM) dimming schema for controlling LED zone driving times. The display device includes an array of driver circuits and LED zones distributed in a display area. The LED zones include one or more LEDs. The display device further includes a control circuit to generate and send dimming signals to the array of driver circuits to control respective duty cycles for driving the LED zones during a frame. Each driver circuit receives the respective duty cycles for the frame at a first time and receives an update signal at a second time. Each driver circuit drives one LED zone according to the respective duty cycles of the dimming signals in response to the update signal. Different groups of driver circuits start driving their respective LED zones at different respective offset times during the frame.

Embodiments also relate to an integrated LED and driver circuit for a display device that operates according to the skewed PWM dimming schema for controlling LED zone driving times. The integrated LED and driver circuit for a display device includes a substrate. The integrated LED and driver circuit further includes a LED zone comprising one or more LEDs in a LED layer over the substrate. The LEDs generate light in response to a driver current. The integrated LED and driver circuit further includes a driver circuit over the substrate in a driver circuit layer and integrated into a common package with the LED zone. The driver circuit obtains a duty cycle for a frame at a first time and receives an update signal at a second time. The driver circuit drives the LED zone according to the duty cycle in response to the update signal.

Embodiments also relate to a method for operating a display device for driving an LED zone in a controlled manner. A control circuit transmits dimming signals to an array of driver circuits distributed in a display area of the display device at a first time. The dimming signals control respective duty cycles for driving an array of LED zones in the display area during a frame. The control circuit transmits one or more update signals to the driver circuits at a second time. A driver circuit in the array of driver circuits drives a LED zone of the array of LED zones. The driver circuits drive the respective LED zones according to the respective duty cycles of the dimming signals in response to the one or more update signals. Different groups of driver circuits start driving their respective LED zones at different respective offset times during the frame.

BRIEF DESCRIPTION OF THE DRAWINGS

The teachings of the embodiments of the present invention can be readily understood by considering the following detailed description in conjunction with the accompanying drawings.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes and may not have been selected to delineate or circumscribe the inventive aspect matter.

DETAILED DESCRIPTION

The Figures (FIGs.) and the following description relate to the preferred embodiments of the present invention by way of illustration only. It should be noted that from the following discussion, alternative embodiments of the structures and methods disclosed herein will be readily recognized as viable alternatives that may be employed without departing from the principles of the present disclosure.

Reference will now be made in detail to several embodiments of the present invention(s), examples of which are illustrated in the accompanying figures. It is noted that wherever practicable similar or like reference numbers may be used in the figures and may indicate similar or like functionality. The figures depict embodiments of the present invention for purposes of illustration only. One skilled in the art will readily recognize from the following description that alternative embodiments of the structures and methods illustrated herein may be employed without departing from the principles of the disclosure described herein.

Figure 1:
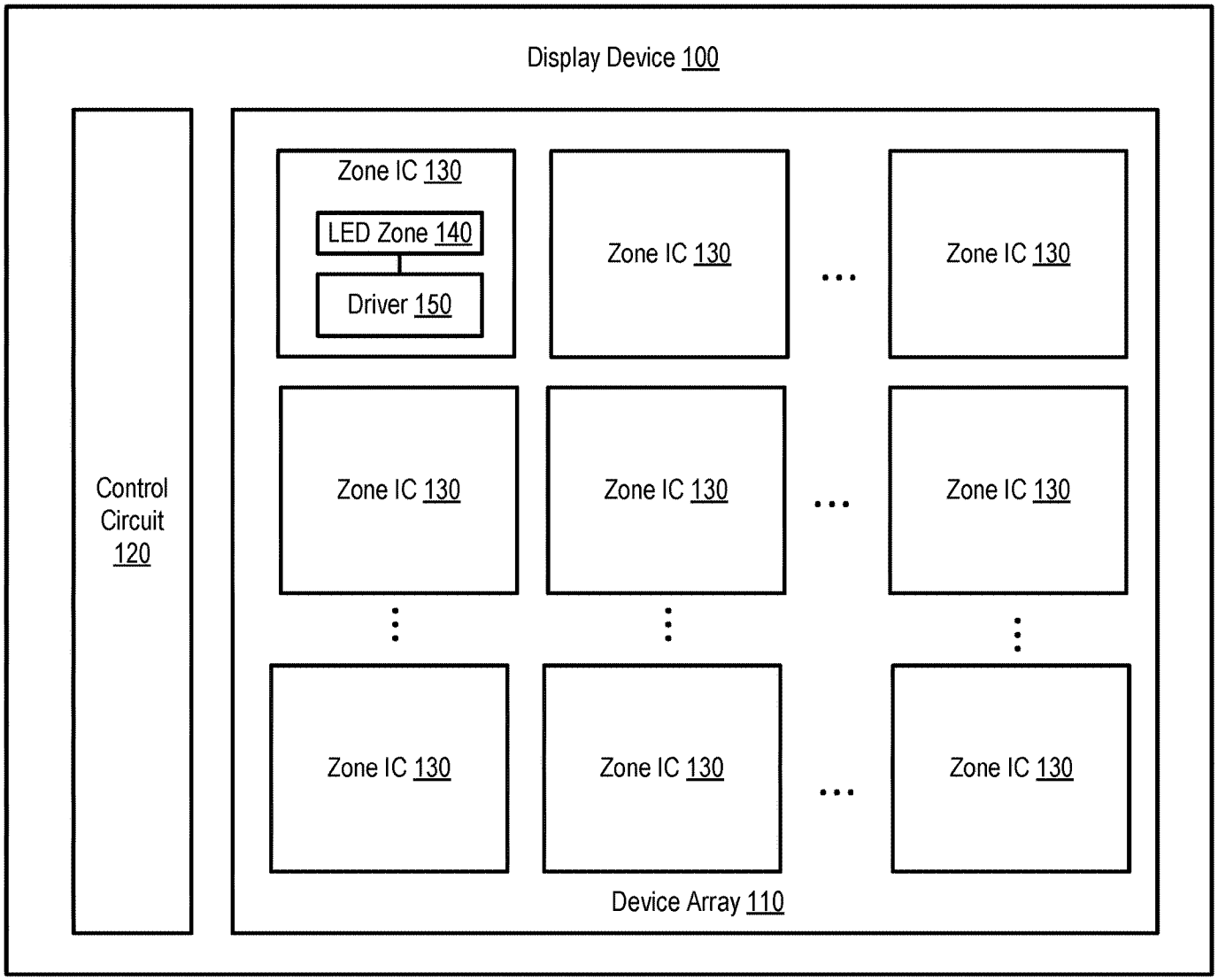
FIG. 1 is a circuit diagram of a display device, according to one embodiment.

FIG. 1 is a circuit diagram of a display device 100 for displaying images or video, according to one embodiment. In various embodiments, the display device 100 may be implemented in any suitable form-factor, including a display screen for a computer display panel, a television, a mobile device, a billboard, etc. The display device 100 may comprise a liquid crystal display (LCD) device or an LED display device. In an LCD display device, LEDs provide white light backlighting that passes through liquid crystal color filters that control the color of individual pixels of the display. In an LED display device, LEDs are directly controlled to emit colored light corresponding to each pixel of the display. The display device 100 may include a device array 110 and a control circuit 120. In various embodiments, the display device 100 may include additional, fewer, or different components.

The device array 110 includes distributed zone integrated circuits (ICs) 130. At least some of the zone ICs 130 include an LED zone 140 and a driver circuit 150 that drives the LED zone 140. In some embodiments, other zone ICs 130 may include sensor devices. In other cases, the zone ICs 130 may include driver circuits 150 that are coupled to external LED zones 140. The device array 110 may be arranged in groups (e.g., rows or columns). Each group of zone ICs 130 may share common control and power lines for the driver circuits 150, LED zones 140, or both.

As will be described in further detail below, the zone ICs 130 may be physically structured such that the LED zones 140 are stacked over the driver circuits 150. In other words, an array of LED zones 140 are arranged in a first x-y plane and an array of driver circuits 150 are arranged in a second x-y plane parallel to the first x-y plane. In one configuration, each LED zone 140 is stacked over (i.e., in the z direction) the corresponding driver circuit 150 that drives it. Furthermore, the LED zone 140 and the driver circuit 150 of a zone IC 130 may be integrated on the same substrate and in a same package as further described in FIGS. 6A-C. This structure enables a display device 100 in which the driver circuits 150 are distributed in a display area and therefore enables a more compact display device 100 than in devices where the driver circuits 150 are external to the display area.

The LED zones 140 each comprise one or more LEDs that each generate light that has a brightness dependent on respective driver currents provided by the corresponding driver circuits 150. In an LCD display, an LED zone 140 may comprise one or more LEDs that provide backlighting for a backlighting zone, which may include a one-dimensional or two-dimensional array of pixels. In an LED display, an LED zone 140 may comprise one or more LEDs corresponding to a single pixel of the display device 100 or may comprise a one-dimensional array or two-dimensional array of LEDs corresponding to an array of pixels (e.g., one or more columns or rows). For example, in one embodiment, the LED zone 140 may comprise one or more groups of red, green, and blue LEDs that each correspond to a sub-pixel of a pixel. In another embodiment, the LED zone 140 may comprise one or more groups of red, green, and blue LED strings that correspond to a column or partial column of sub-pixels or a row or partial row of sub-pixels. For example, an LED zone 140 may comprise a set of red sub-pixels, a set of green sub-pixels, or a set of blue sub-pixels.

The LEDs may be organic light emitting diodes (OLEDs), inorganic light emitting diodes (ILEDs), mini light emitting diodes (mini-LEDs) (e.g., having a size range between 100 to 300 micrometers), micro light emitting diodes (micro-LEDs) (e.g., having a size of less than 100 micrometers), white light emitting diodes (WLEDs), active-matrix OLEDs (AMOLEDs), transparent OLEDs (TOLEDs), or some other type of LEDs.

The driver circuits 150 drive the LED zones 140 by controlling the respective driver currents supplied to the LED zones 140 in response to driver control signals. In an embodiment, a driver circuit 150 controls a driver current supplied by a power supply (not shown) to control brightness of the LED zone 140 based on the driver control signals. For example, the driver circuits 150 may utilize a pulse width modulation (PWM) technique to control the brightness by modifying a duty cycle for each frame.

In some embodiments, the driver circuits 150 each drive multiple channels of a corresponding LED zone 140 that may each have separately controllable driver currents. For example, the driver circuit 150 may independently control LED currents corresponding to red, green, and blue channels of the LED zones 140.

The driver circuits 150 may be arranged in groups that share a common set of driver control lines. A group of driver circuits 150 can correspond to, for example, a row of driver circuits 150, a column of driver circuits 150, a partial row or partial column of driver circuits 150, or a block of adjacent driver circuits 150 that may span multiple rows or columns.

The control circuit 120 generates dimming signals as driver control signals according to image or video data. The dimming signals control the PWM on-times for each driver circuit 150 and controls a relative skew of the PWM on-times so that different driver circuits 150 or groups of driver circuits 150 turn on their corresponding LED zones 140 at different start times during each frame. The control circuit 120 provides the dimming signals to the driver circuits 150 for each image or video frame to control when each LED zone 140 turns on and to control their respective duty cycles. Different processes for controlling the relative skew of the PWM on-times of LED zones 140 are described in further detail in FIGS. 2-4.

In different embodiments, different connectivity configurations may be employed to couple the control circuit 120 to the zone ICs 130 for communicating the driver control signals. For example, in an embodiment, each group of zone ICs 130 is coupled by a shared parallel communication line that provides the driver control signals to the zone ICs 130 and targets different signals to different zone ICs 130 using unique addresses. The shared parallel communication line may comprise a dedicated communication line or may comprise a power communication line that both provides a supply voltage to the zone ICs 130 and includes digital data modulated on the supply voltage. In this embodiment, the zone ICs 130 may furthermore include serial connections between adjacent zone ICs 130 in a group and between the group of zone ICs 130 and the control circuit 120 to form a serial communication chain. The serial communication chain may be utilized to facilitate assignment of addresses to the zone ICs 130 at startup, may be used to communicate various commands to the zone ICs 130, and/or may be used to communicate readback data from the zone ICs 130 to the control circuit 120.

Alternatively, the control circuit 120 may include sets of control lines across multiple dimensions to facilitate communication of the driver control signals without addresses. Here, a group of zone ICs 130 along a first dimension (e.g., a row) may be selected based on a first shared control line coupled to all the zone ICs 130 in the group. Then the driver control signals may be communicated in parallel using a set of separate control lines that may be shared between zone ICs 130 along a second dimension (e.g., a column).

Figure 2A:
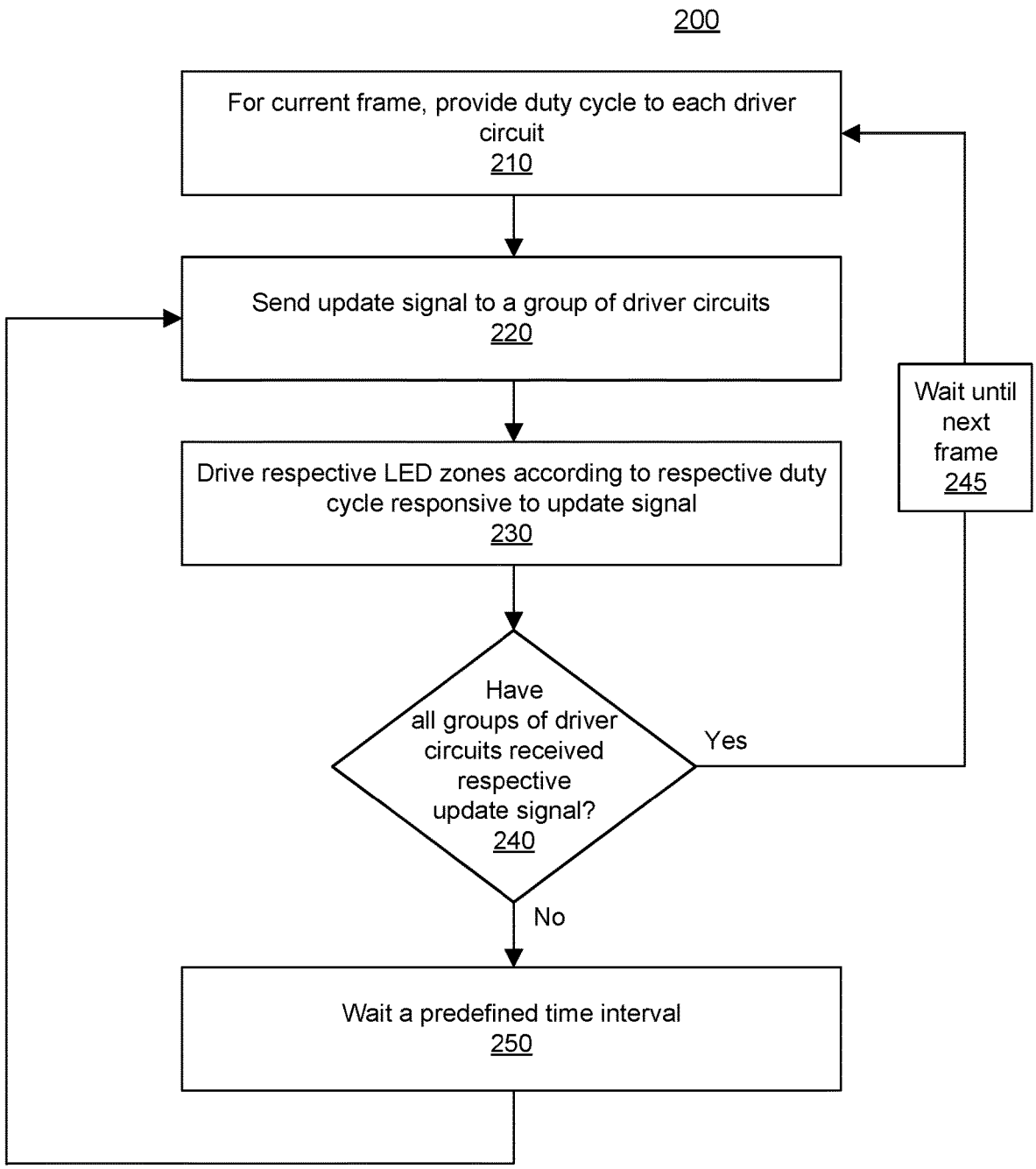
FIG. 2A is a flow chart illustrating a first process for driving LED zones of a display device, according to one embodiment.

FIG. 2A is a flow chart illustrating a first process 200 for driving LED zones 140 of a display device 100 for displaying image or video frames, according to one embodiment.

A control circuit 120 of the display device 100 provides 210 respective duty cycles to each individual driver circuit 150 for displaying a current image or video frame via a duty cycle signal. After all of the driver circuits 150 receive their respective duty cycles for the frame, the control circuit 120 sends 220 an update signal to a selected group of driver circuits 150 (e.g., a row). The update signal may be sent via a shared communication line for the group of driver circuits 150. The driver circuits 150 in the selected group each drive 230 their respective LED zones 140 according to the duty cycle information of their respective duty cycle signals responsive to the update signal. For example, each driver circuit 150 in the group begins driving (i.e., turning on) its corresponding LED zone 140 immediately after, or a fixed time after, the driver circuits 150 receive the update signal. The control circuit 120 determines 240 if all groups of driver circuits 150 have received a respective update signal for the current frame. If all groups of driver circuits 150 have not received a respective update signal, the control circuit 120 waits 250 a predefined time interval (e.g., an amount of time less than the image or video frame period) and sends 220 a respective update signal to the next group of driver circuits 150. The driver circuits 150 of the next group begin driving 230 their respective LED zones 140 according to duty cycle information of their respective duty cycle signals responsive to the update signal. This repeats for each group of driver circuits 150. If all groups of driver circuits 150 have received their respective update signals, the control circuit 120 waits 245 until the next frame time, and the process 200 repeats according to the dimming data for the next frame.

Figure 2B:
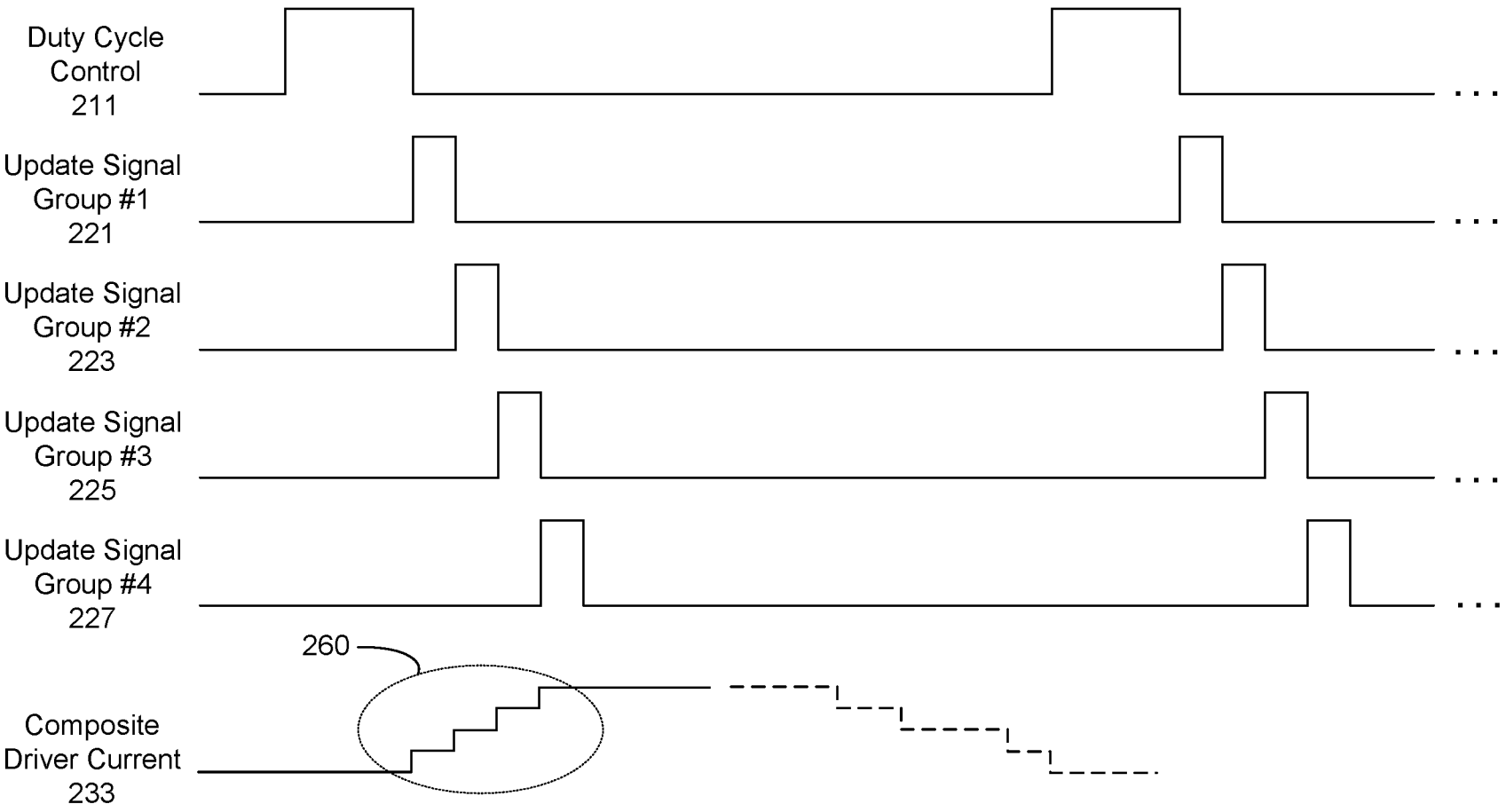
FIG. 2B is a waveform diagram illustrating operation of the display device according to the first process.

FIG. 2B is a waveform diagram illustrating operation of the display device 100 according to the first process 200.

The duty cycle signals are sent to each of the driver circuits 150 of the display device 100 during a duty cycle control period 211 prior to or at the beginning of a frame.

Update signals (e.g., an update signal 221 for a first group of driver circuits 150, update signal 223 for a second group of driver circuits 150, update signal 225 for a third group of driver circuits 150, and update signal 227 for a fourth group of driver circuits 150) are asserted sequentially such that the update signal for each group of driver circuits 150 is delayed relative to the update signal for a previous group of driver circuits 150.

The driver circuits 150 in each group begin driving their respective LED zones 140 responsive to the update signals 221, 223, 225, 227 so that each group turns their respective LED zones 140 on at different start times. The composite driver current waveform 233 illustrates the combined driver currents being supplied to all of the LED zones 140 of the display device 100. In portion 260 of the waveform 233, the composite driver current gradually increases over time as each group of driver circuits 150 begins providing driver currents to their respective LED zone 140 responsive to the respective update signals. Each individual driver circuit 150 turns off its corresponding LED zone 140 after a drive time based on its programmed duty cycle for the current frame. By offsetting (or skewing) the update signals 221, 223, 225, 227, the display device 100 reduces the transient drive current for driving the LED zones 140 relative to an operating technique that instead turns on all LED zones 140 simultaneously.

Figure 3A:
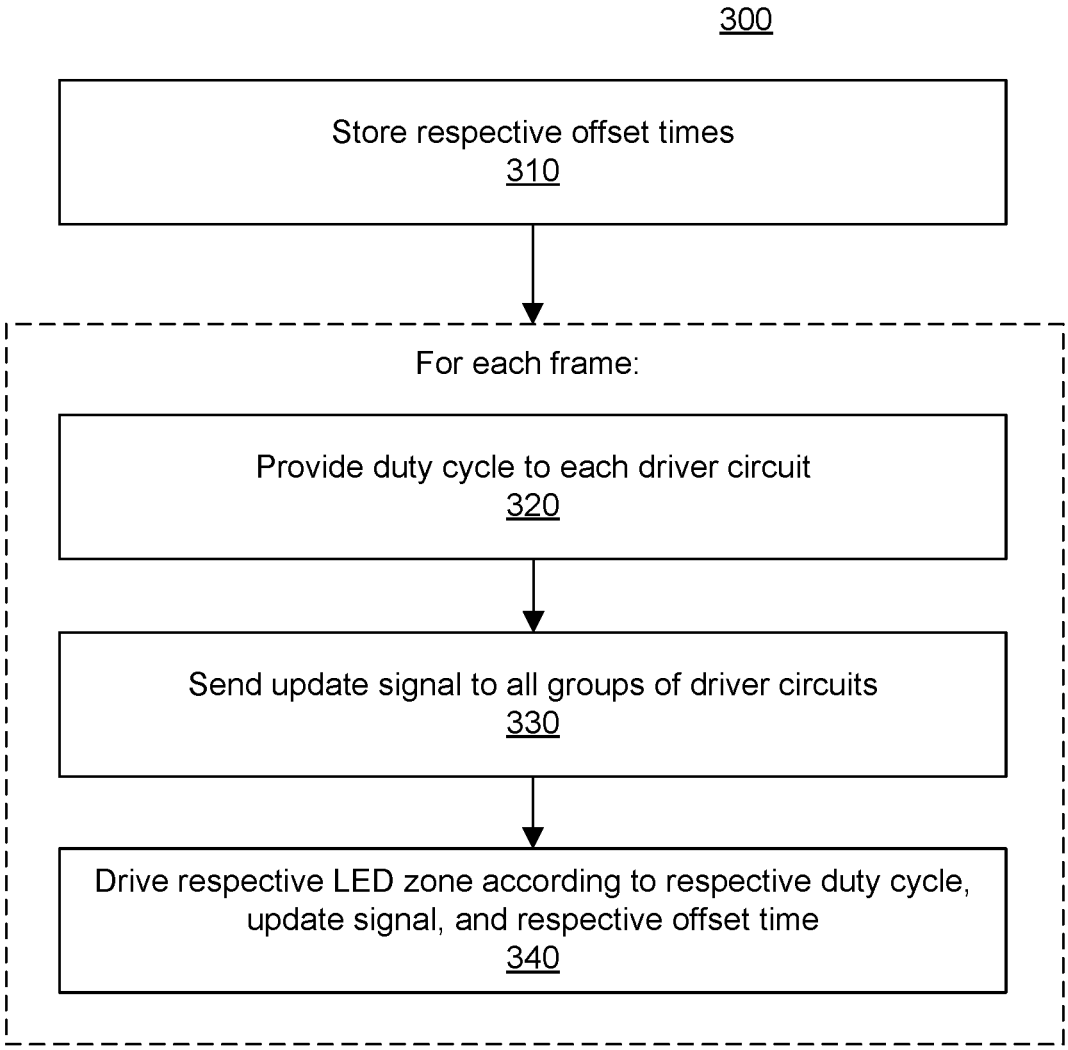
FIG. 3A is a flow chart illustrating a second process for driving LED zones of a display device, according to one embodiment.

FIG. 3A is a flow chart illustrating a second process 300 for driving LED zones 140 of a display device 100, according to one embodiment. In this embodiment, each driver circuit 150 of the display device 100 stores 310 a respective offset time that controls how long the driver circuit 150 waits after receiving an update signal before it begins driving its corresponding LED zone 140. The offset times may be provided by a control circuit 120 to the driver circuits 150 during a configuration mode of the display device 100, during an operation mode of the display device 100, or may be preprogrammed into the driver circuits 150. For example, during an operation mode of the display device, the control circuit 120 may provide the offset times at the start of each frame. During an operation mode for each image or video frame presented by the display device 100, the control circuit 120 provides 320 respective duty cycles to each driver circuit 150 for displaying the image or video frame. The control circuit 120 sends 330 an update signal to all driver circuits 150 at the same time. The driver circuits 150 drive 340 the respective LED zones 140 according to their respective duty cycle information with each driver circuit 150 waiting its programmed offset time after receiving the update signal to begin driving. Thus, different groups of driver circuits 150 begin driving their respective LED zones 140 at different times, depending on their programmed offset times. The process repeats steps 320, 330, 340 for each frame.

Figure 3B:
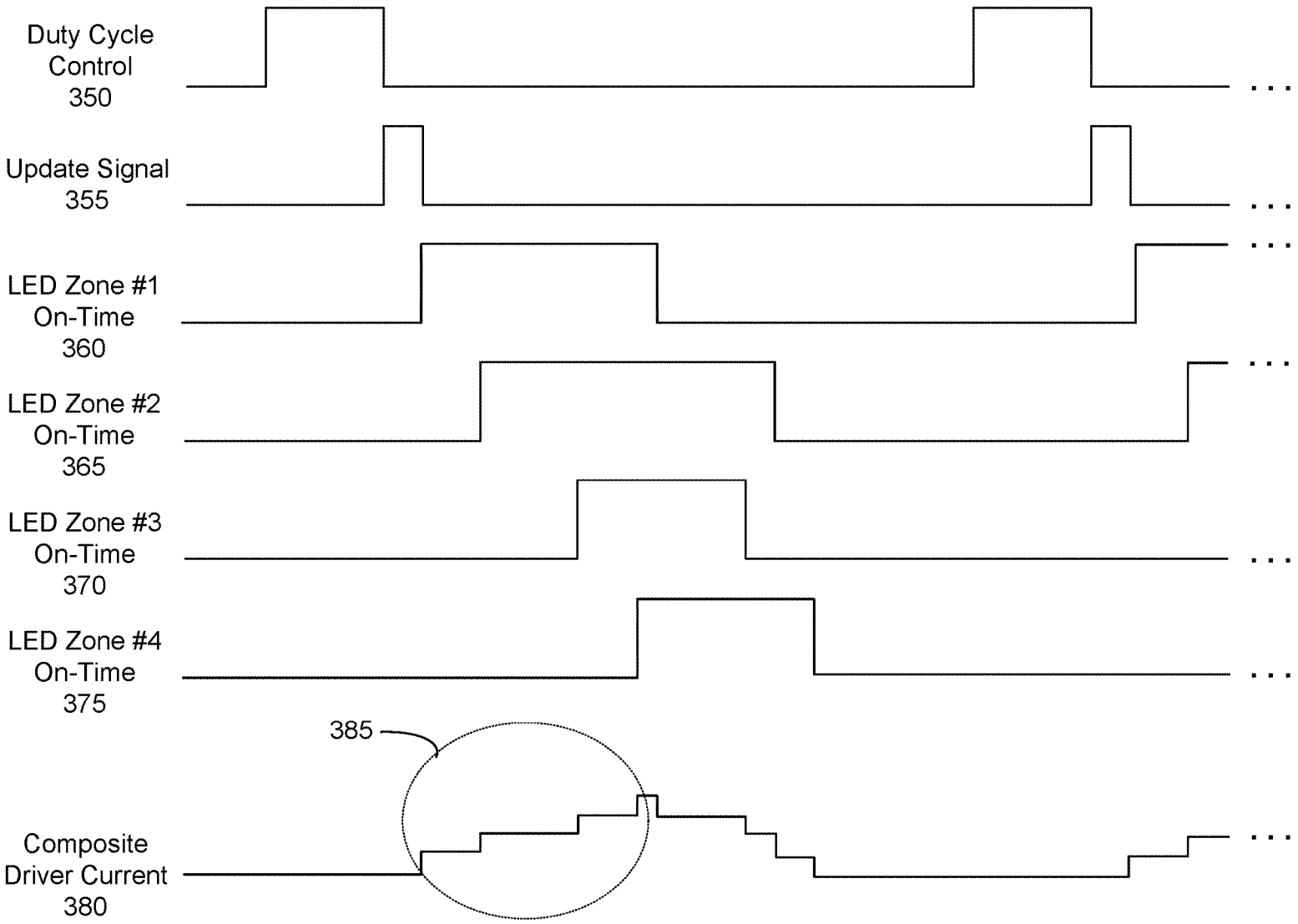
FIG. 3B is a waveform diagram illustrating operation of the display device according to the second process.

FIG. 3B is a waveform diagram illustrating operation of the display device 100 according to the second process 300. The duty cycle signals are provided to the driver circuits 150 during a duty cycle control period 350 prior to or at the beginning of a frame. An update signal 355 is then provided to all driver circuits 150 after the driver circuits 150 receive the duty cycle information. The driver circuits 150 each turn on their corresponding LED zones 140 responsive to the update signal 355. FIG. 3B illustrates example on-times 360, 365, 370, 375 for four example LED zones 140. Each driver circuit 150 waits a respective offset time after receiving the update signal 355 and then turns on its respective LED zone 140 for an amount of time controlled by their respective duty cycle so that the LED zones 140 turn on at different times. Each LED zone 140 then turns off after a time period based on its programmed duty cycle for the frame.

The composite driver current waveform 380 illustrates the combined driver currents from all driver circuits 150 to their respective LED zones 140 of the display device 100. In portion 385 of the waveform 380, the composite driver current gradually increases over time as different groups of driver circuits 150 turn on their respective LED zone 140 based on the programmed offset times.

In some embodiments, the first process 200 and the second process 300 may be combined in the operation of a display device 100. Here, the control circuit 120 provides separate update signals to each group of driver circuits 150 and individual driver circuits 150 in the group turn on their respective LED zones 140 after a preprogrammed offset time.

Figure 4A:
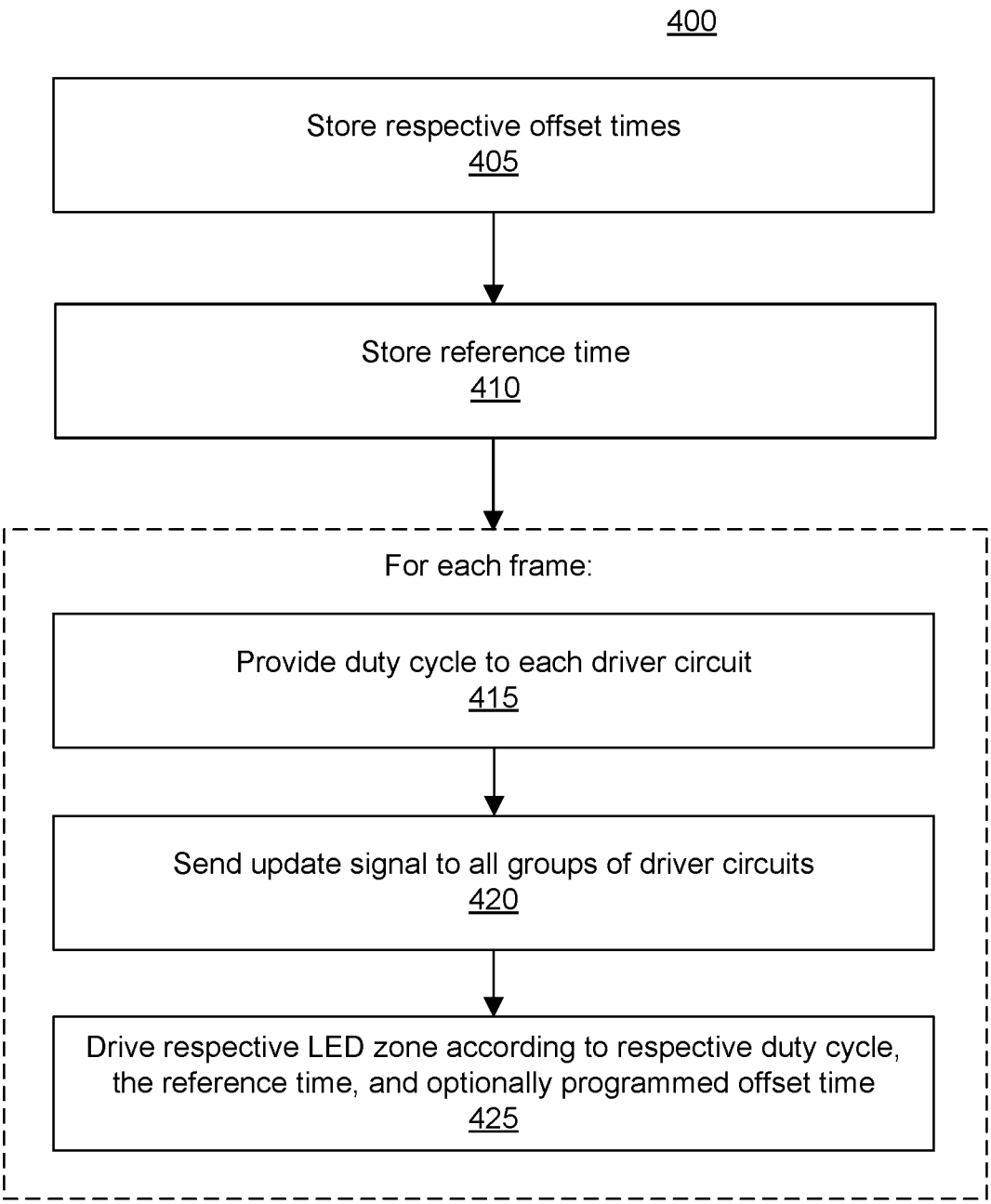
FIG. 4A is a flow chart illustrating a third process for driving LED zones of a display device, according to one embodiment.

FIG. 4A is a flow chart illustrating a third process 400 for driving LED zones 140 of a display device 100, according to one embodiment. Each driver circuit 150 optionally stores 405 a respective offset time. The offset times may be provided by a control circuit 120 to the driver circuits 150 during a configuration mode of the display device 100, during each frame of an operation mode of the display device 100, or may be preprogrammed into the driver circuits 150. Each driver circuit 150 also stores 410 a respective reference time relative to a frame start time. The control circuit 120 may provide the reference time to the driver circuits 150 during the configuration mode, during each frame of the operation mode, or the reference time may be a fixed preprogrammed time. In some embodiments, each driver circuit 150 stores the same reference time. For each frame, the control circuit 120 provides 415 respective duty cycles to each driver circuit 150 for displaying the image or video frame. The control circuit 120 sends 420 an update signal to the driver circuits 150. In this embodiment, the update signal may simply indicate the start of the frame time, or may occur at another fixed time relative to the start of the frame time. The driver circuits 150 then drive 425 respective LED zones 140 according to the respective duty cycle information, the reference time, and optionally the respective programmed offsets so that the start of the on-time for each driver circuit 150 varies with the duty cycle.

In an example implementation, each driver circuit 150 may turn on their respective LED zone 140 such that the midpoint of the on-time (set by the duty cycle for the driver circuit) corresponds to the reference time. For example, if the reference time is set to a midpoint of the frame and a duty cycle for a driver circuit is set to 50%, the driver circuit 150 turns on its corresponding LED zone 140 after 25% of the frame time has passed, and turns off the LED zone 140 after 75% of the frame time has passed. In other embodiments, the driver circuits 150 may turn on the respective LED zones 140 so that the reference time occurs after a different fixed fraction of the on-time set by the duty cycle has passed that is not necessarily the midpoint. For example, the driver circuits 150 may turn on the respective LED zones 140 so that the reference time occurs after 25% of the on-time, after 75% of the on-time, or after any other programmed proportion. Furthermore, the reference time need not necessarily correspond to the midpoint of the frame time and may occur at any other preprogrammed time during the frame. In the case that the driver circuits 150 additionally receive a programmed offset time, the time at which the driver circuit 150 turns on the respected LED zone 140 may first be computed using the technique above and then adjusted by the programmed offset. The offset times may be positive to cause the midpoint (or other programmed point) of the on-time to lag the time indicated by the reference time in conjunction with the duty cycle, or the offset time may be negative to cause the midpoint (or other programmed point) of the on-time to precede the time indicated by the reference in conjunction with the duty cycle. In general, the time at which the LED zone 140 turns on may be computed as follows:

$$T_{ON}(i)=T_{Ref}-D(i)\cdot F_T\cdot P+T_{Offset}(i) \quad (1)$$

where $T_{ON}$ represents the time at which the LED zone i turns on relative to the start of the frame (or the update signal), $T_{REF}$ is the reference time relative to the start of the frame, D is the duty cycle for a specific driver circuit driving the LED zone i, $F_T$ is the duration of the frame, P is a position value between 0 and 1 indicating a fraction of the on-time set by the duty cycle that occurs prior to the reference time, and $T_{OFFSET}$ represents a programmed offset time associated with the driver circuit 150 driving the LED zone i. The steps 415, 420, 425 repeat for each frame.

In an embodiment, the offsets $T_{OFFSET}$ may be applied only in situations when the duty cycles for multiple driver circuits 150 are the same or very close to ensure that the driver circuits 150 still turn on their respective LED zones 140 at different times. For example, the control circuit 120 may detect when over a threshold number of driver circuits 150 are programmed to operate with coincident turn on times and cause the driver circuits 150 to operate according to programmed offsets in response. Alternatively, if a group of driver circuits 150 share a common control line, the driver circuits 150 may individually detect when at least a threshold number of other driver circuits 150 in the group are programmed with coincident turn on times and apply a programmed offset in response. Thus, in this embodiment, the turn on times are selectively skewed by the offset times dependent on the control data for that frame.

In a further embodiment, the update signals may be sent at different times for different groups (e.g., rows) of driver circuits 150. Each driver circuit 150 in a group may then operate according to the principles described above. In this embodiment, the total skew for a driver circuit 150 is dependent on both its group association (e.g., what row it is in) and its programmed or computed time at which the driver circuit 150 turns on the respective LED zone 140 relative to the timing of the update signal.

In a further embodiment, the control circuit 120 may detect when over a threshold number of driver circuits 150 are programmed to operate with coincident turn off times and cause the driver circuits 150 to operate according to programmed offsets in response to shift the respective turn on times in a manner that avoids the turn off times coinciding. Alternatively, if a group of driver circuits 150 share a common control line, the driver circuits 150 may individually detect when at least a threshold number of other driver circuits 150 in the group are programmed with coincident turn off times and apply a programmed offset in response to shift the respective turn on times in a manner that avoids the turn off times coinciding. Thus, in this embodiment, the turn off times are selectively skewed by the offset times dependent on the control data for that frame.

Figure 4B:
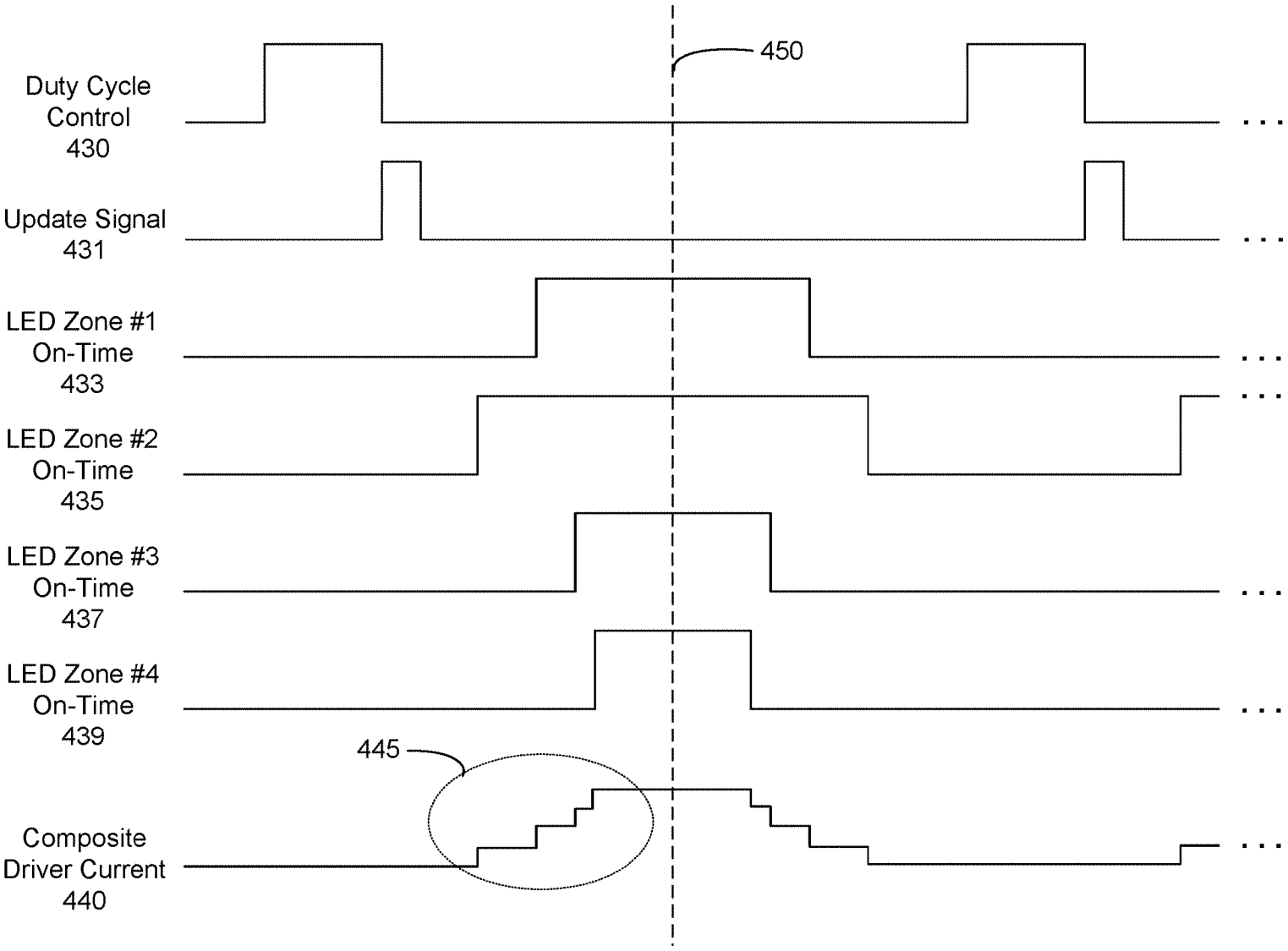
FIG. 4B is a first waveform diagram illustrating operation of the display device according to the third process.

FIG. 4B is a first waveform diagram illustrating operation of the display device 100 according to the third process 400. The duty cycle signals are provided to the driver circuits 150 during a duty cycle control period 430 prior to or at the beginning of a frame. An update signal 431 is provided to all driver circuits 150 after the driver circuits 150 receive the duty cycle information.

FIG. 4B illustrates example on-times 433, 435, 437, 439 for four LED zones 140. In this example, the reference time 450 is set to a midpoint of the frame ($T_{REF}=0.5*F_T$), the start of on-times are configured to occur so that they are centered at the midpoint (e.g., P=0.5), and no offsets are applied (e.g., $T_{OFFSET}=0$). Since the duty cycles provided to each of the driver circuits 150 are different, the driver circuits 150 turn on and turn off their corresponding LED zones 140 at different times that depend on the respective duty cycles.

The composite driver current waveform 440 illustrates the combined driver currents being supplied from all driver circuits 150 to their respective LED zones 140 of the display device 100. In portion 445 of the waveform 440, the composite driver current gradually increases over time as different driver circuits 150 turn on their respective LED zone 140 so that the rate of transient current change is limited. Similarly, the composite driver current 440 indicates gradually decreasing current as different driver circuits turn off their respective LED zones 140 at different times.

Figure 4C:
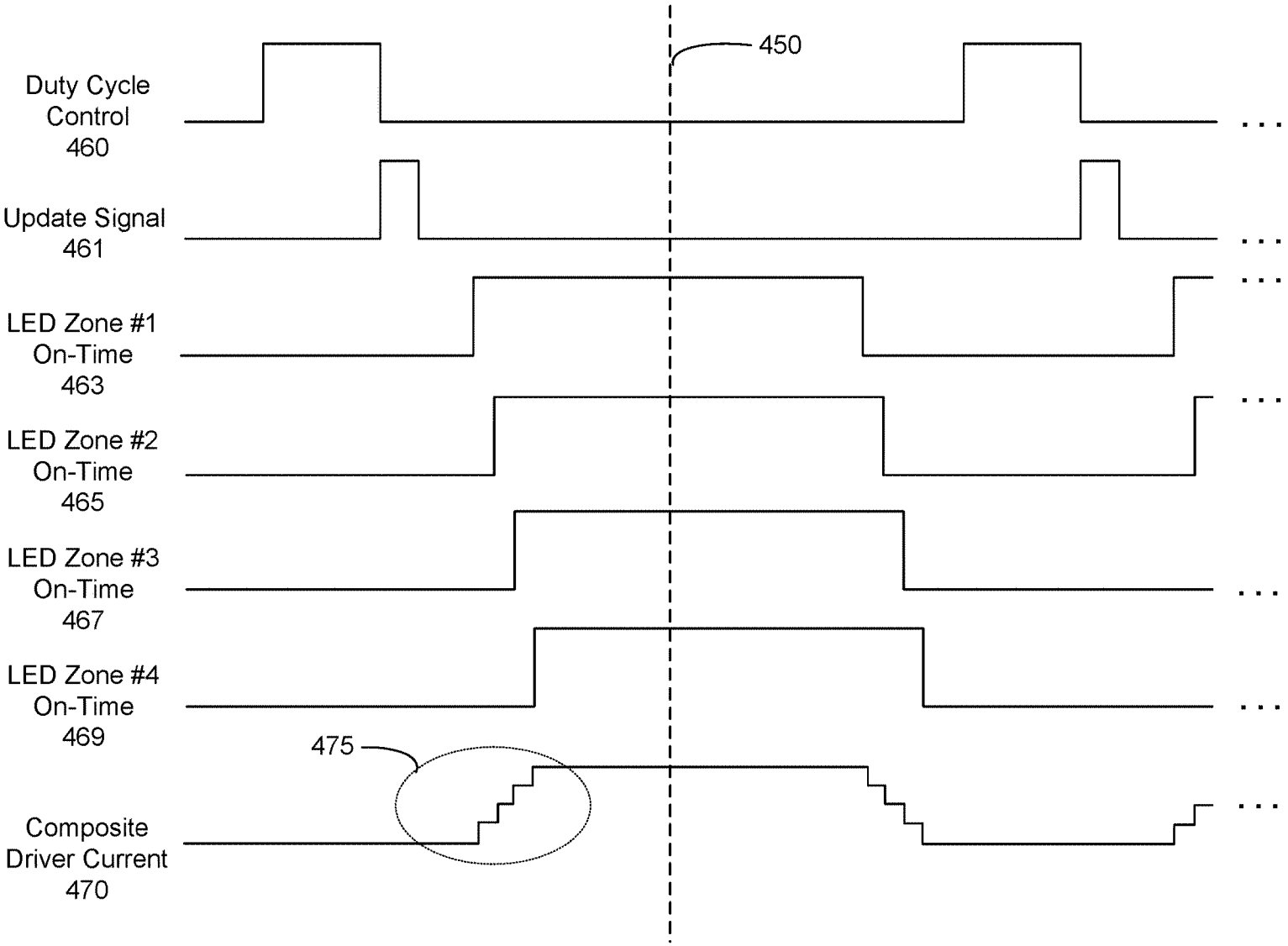
FIG. 4C is a second waveform diagram illustrating operation of the display device according to the third process.

FIG. 4C is a second waveform diagram illustrating operation of the display device 100 according to the third process 400. The duty cycle signals are provided to the driver circuits 150 during a duty cycle control period 460 prior to or at the beginning of a frame. An update signal 461 is provided to the driver circuits 150 after the driver circuits 150 receive the duty cycle information. FIG. 4C illustrates on-times 463, 465, 467, 469 for four example LED zones 140. The example is similar to the example of FIG. 4B, but in this case the driver circuits 150 each operate with a different offset. For example, in this example, the on-times 463, 465, 467, 469 occur with sequentially increasing offset. This ensures that the times at which the driver circuits 150 turn on their respective LED zone 140 (and turn off their respective LED zones 140) are different even though the duty cycles in this example are each very similar.

The composite driver current waveform 470 illustrates the combined driver currents being supplied from all driver circuits 150 to their respective LED zones 140 of the display device 100. In portion 475 of the waveform 440, the composite driver current gradually increases over time as different driver circuits 150 turn on their respective LED zone 140. Similarly, the composite driver current 475 indicates gradually decreasing current as different driver circuits turn off their respective LED zones 140 at different times.

Figure 4D:
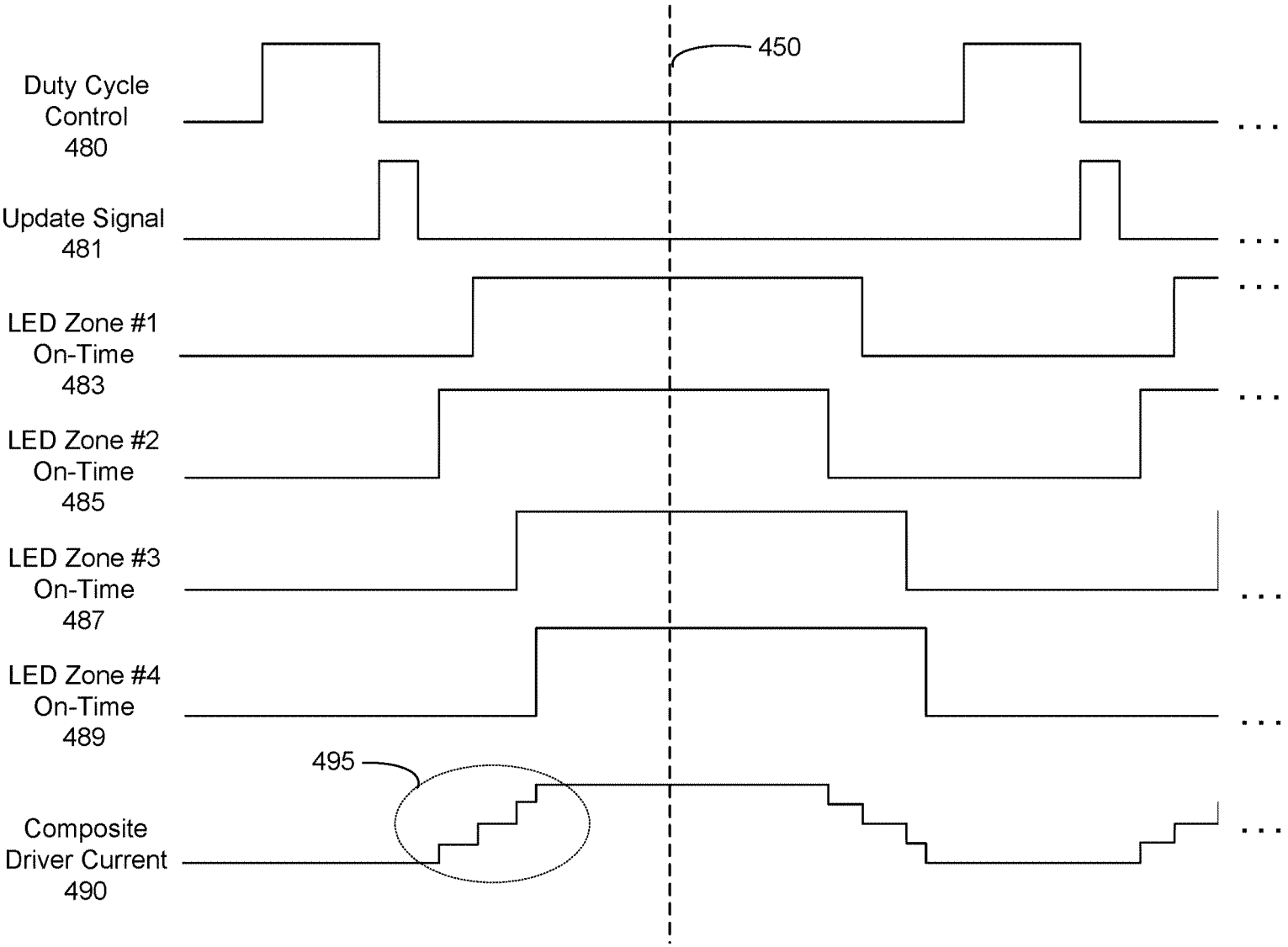
FIG. 4D is a third waveform diagram illustrating operation of the display device according to the third process.

FIG. 4D is a third waveform diagram illustrating operation of the display device 100 according to the third process 400. The duty cycle signals are provided to the driver circuits 150 during a duty cycle control period 480 prior to or at the beginning of a frame. An update signal 481 is provided to the driver circuits 150 after the driver circuits 150 receive the duty cycle information. FIG. 4D illustrates example on-times 483, 485, 487, 489 for four LED zones 140. The example is similar to the example of FIG. 4C described above, except in this case, arbitrary offsets are applied by different driver circuits 150 that are not necessarily sequential. Furthermore, in this example, at least one of the programmed offsets maybe negative so that the time at which the driver circuit 150 turns on its respective LED zone 140 occurs prior to the time that would normally be indicated by the programmed duty cycle and programmed reference time 450 absent the programmed offset.

The composite driver current waveform 490 illustrates the combined driver currents being supplied from all driver circuits 150 to their respective LED zones 140 of the display device 100. In portion 495 of the waveform 490, the composite driver current gradually increases over time as different driver circuits 150 turn on their respective LED zone 140 at different times. Similarly, the composite driver current 490 indicates gradually decreasing current as different driver circuits turn off their respective LED zones 140 at different times.

In the embodiments of FIGS. 2-4, the groups of driver circuits 150 that may receive the same update signal or be programmed with the same offset time may be arbitrary and do not necessarily correspond to groups of driver circuits having common control and supply lines described with respect to FIG. 1. For example, in FIGS. 2-4, the groups of driver circuits 150 that may receive the same update signal or be programmed with the same offset time may comprise a row or partial row of driver circuits 150, a column or partial column of driver circuits 150, a block of adjacent driver circuits 150, or any arbitrary group of driver circuits 150 that are not necessarily adjacent.

Figure 5:
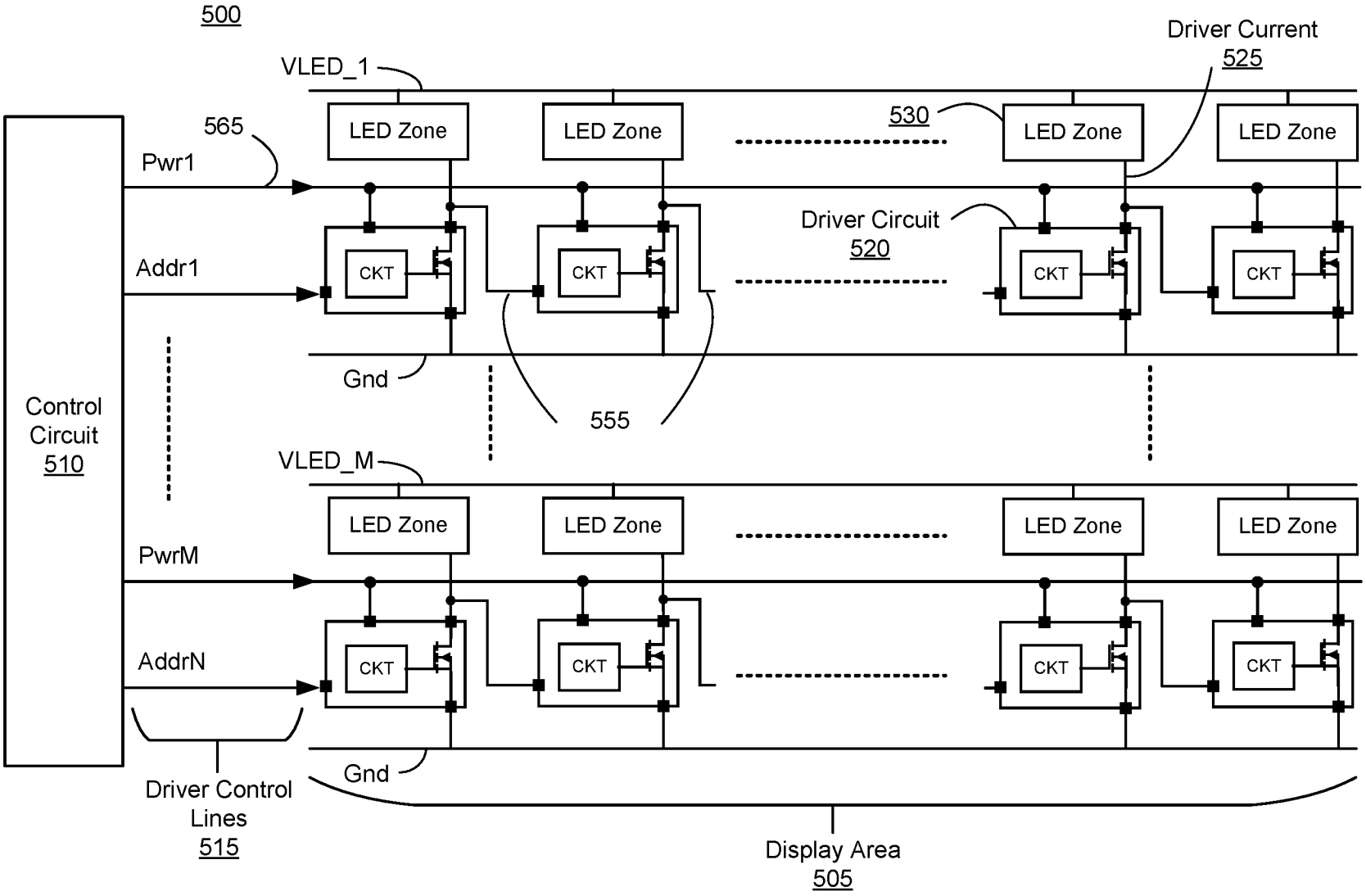
FIG. 5 is a circuit diagram of a display device with serial daisy-chain connections, according to one embodiment.

FIG. 5 is a circuit diagram of a display device 500 with serial daisy-chain connections, according to one embodiment. The display device 500 is one example implementation of the general display device 100 described in FIG. 1. In FIG. 5, each row of the display device 500 corresponds to a group of driver circuits 520 that share a common set of driver control lines 515, VLED lines, ground GND lines, and various signaling lines including serial communication lines 555 connecting adjacent driver circuits 520 in a serial communication chain and power communication lines 565 coupling to the group of driver circuits 520 in parallel. The power communication line 565 supplies both power and data to the driver circuits 520 as a supply voltage modulated with digital data.

The driver circuits 520 may operate in various modes including at least an addressing mode, a configuration mode, and an operational mode. During the addressing mode, the control circuit 510 initiates an addressing procedure to cause assignment of addresses to each of driver circuits 520. During the configuration and operational modes, the control circuit 510 transmits commands and data that may be targeted to specific driver circuits 520 based on their addresses. In the configuration mode, the control circuit 510 configures driver circuits 520 with one or more operating parameters (e.g., overcurrent thresholds, overvoltage thresholds, clock division ratios, and/or slew rate control). During the operational mode, the control circuit 510 provides control data to the driver circuits 520 that causes the driver circuits 520 to control the respective driver currents to the LED zones 530, thereby controlling brightness.

The serial communication lines 555 may be utilized in the addressing mode to facilitate assignment of addresses. Here, an addressing signal is sent from the control circuit 510 via the serial communication lines 555 to the first driver circuit 520 in a group of driver circuits 520. The first driver circuit 520 stores an address based on the incoming addressing signal and generates an outgoing addressing signal for outputting to the next driver circuit 520 via the serial communication line 555. The second driver circuit 520 similarly receives the addressing signal from the first driver circuit 520, stores an address based on the incoming addressing signal, and outputs an outgoing addressing signal to the next driver circuit 520. This process continues through the chain of driver circuits 520. The addressing process may be performed in parallel or sequentially for each group of driver circuits 520.

In an example addressing scheme, each driver circuit 520 may receive an address, store the address, increment the address by one or by another fixed amount, and send the incremented address as an outgoing addressing signal to the driver circuit 520 in the group. Alternatively, each driver circuit 520 may receive the address of the prior driver circuit 520, increment the address, store the incremented address, and send the incremented address to the next driver circuit 520. In other embodiments, the driver circuit 520 may generate an address based on the incoming address signal according to a different function (e.g., decrementing).

After addressing, dimming commands may be sent to the driver circuit 520 based on the addresses. For example, during the operational mode, dimming data can be broadcast to a group of driver circuits 520 via the power communication line 565 to configure the duty cycles and provide update signals or other timing information.

Figure 6A:
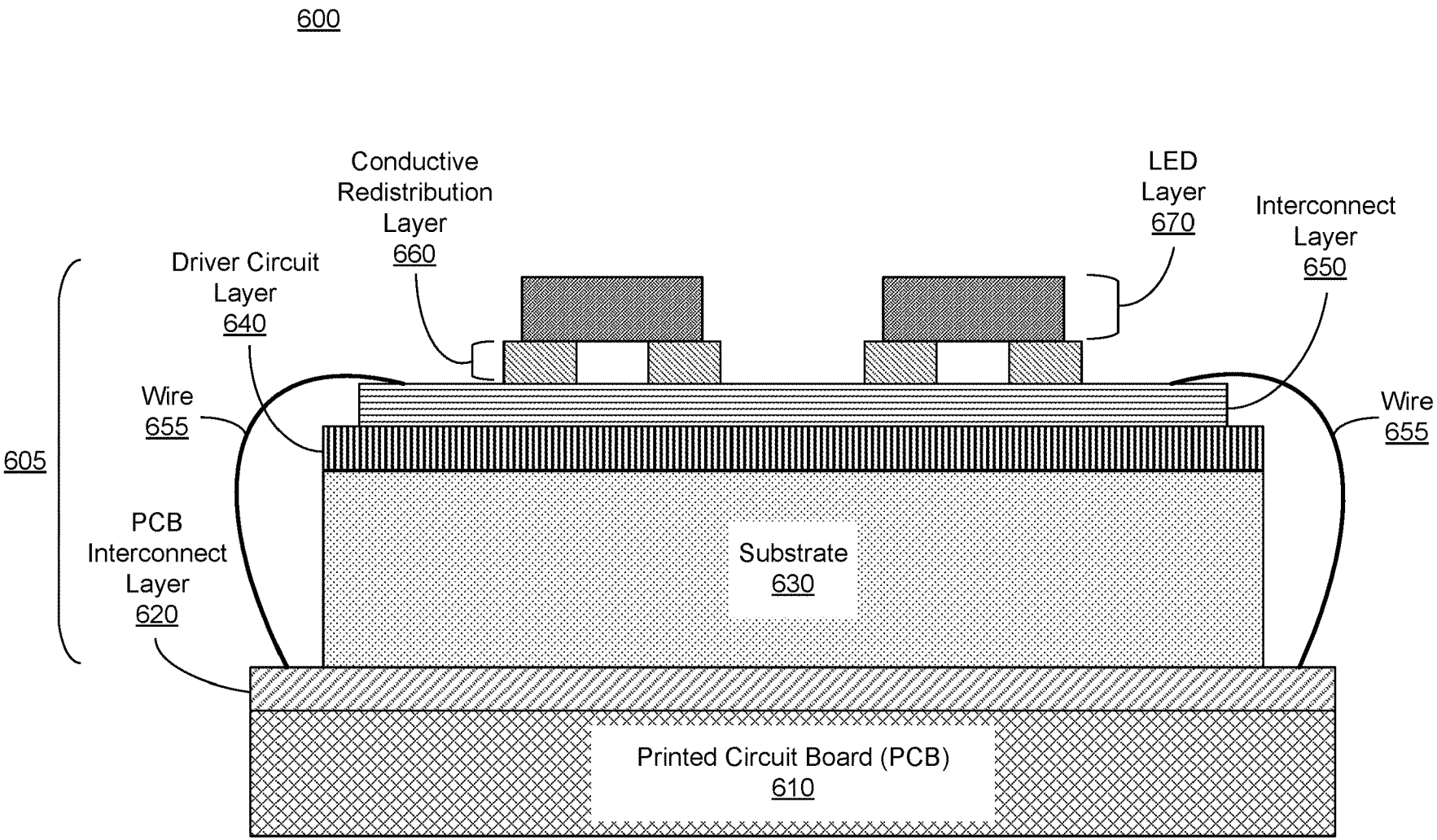
FIG. 6A a cross sectional view of a first embodiment of an LED and driver circuit that may be utilized in a display device.

FIG. 6A a cross sectional view of a display device 600 including an integrated LED and driver circuit 605.

In the example shown in FIG. 6A, the display device 600 includes a printed circuit board (PCB) 610, a PCB interconnect layer 620, and the integrated LED and driver circuit 605 which comprises a substrate 630, a driver circuit layer 640, an interconnect layer 650, a conductive redistribution layer 660, and an LED layer 670. Bonded wires 655 may be included for connections between the PCB interconnect layer 620 and the integrated LED and driver circuit 605. The PCB 610 comprises a support board for mounting the integrated LED and driver circuit 605, the control circuit 120 and various other supporting electronics. The PCB 610 may include internal electrical traces and/or vias that provide electrical connections between the electronics. A PCB interconnect layer 620 may be formed on a surface of the PCB 610. The PCB interconnect layer 620 includes pads for mounting the various electronics and traces for connecting between them.

The integrated LED and driver circuit 605 includes the substrate 630 that is mountable on a surface of the PCB interconnect layer 620. The substrate 630 may be, e.g., a silicon (Si) substrate. In other embodiments, the substrate 630 may include various materials, such as gallium arsenide (GaAs), indium phosphide (InP), gallium nitride (GaN), aluminum nitride (AlN), sapphire, silicon carbide (SiC), or the like.

The driver circuit layer 640 may be fabricated on a surface of the substrate 630 using silicon transistor processes (e.g., BCD processing). The driver circuit layer 640 may include one or more driver circuits 150 (e.g., a single driver circuit 150 or a group of driver circuits 150 arranged in an array). The interconnect layer 650 may be formed on a surface of the driver circuit layer 640. The interconnect layer 650 may include one or more metal or metal alloy materials, such as Al, Ag, Au, Pt, Ti, Cu, or any combination thereof. The interconnect layer 650 may include electrical traces to electrically connect the driver circuits 150 in the driver circuit layer 640 to wire bonds 655, which are in turn connected to the control circuit 120 on the PCB 610. In an embodiment, each wire bond 655 provides an electrical connection between the driver circuit 150 or LED zone 140 and the control circuit 120 or other electronic components (e.g., power and ground lines). Additionally, the interconnect layer 650 may provide electrical connections for supplying the driver current between the driver circuit layer 640 and the conductive redistribution layer 660.

In an embodiment, the interconnect layer 650 is not necessarily distinct from the driver circuit layer 640 and these layers 640, 650 may be formed in a single process in which the interconnect layer 650 represents a top surface of the driver circuit layer 640.

The conductive redistribution layer 660 may be formed on a surface of the interconnect layer 650. The conductive redistribution layer 660 may include a metallic grid made of a conductive material, such as Cu, Ag, Au, Al, or the like. The LED layer 670 includes LEDs that are on a surface of the conductive redistribution layer 660. The LED layer 670 may include arrays of LEDs arranged into the LED zones 140 as described above. The conductive redistribution layer 660 provides an electrical connection between the LEDs in the LED layer 670 and the one or more driver circuits in the driver circuit layer 640 for supplying the driver current and provides a mechanical connection securing the LEDs over the substrate 630 such that the LED layer 670 and the conductive redistribution layer 660 are vertically stacked over the driver circuit layer 640.

Thus, in the illustrated circuit 605, the one or more driver circuits 150 and the LED zones 140 including the LEDs are integrated in a single package including a substrate 630 with the LEDs in an LED layer 670 stacked over the driver circuits 150 in the driver circuit layer 640. By stacking the LED layer 670 over the driver circuit layer 640 in this manner, the driver circuits 150 can be distributed in the display area of a display device 100.

Figure 6B:
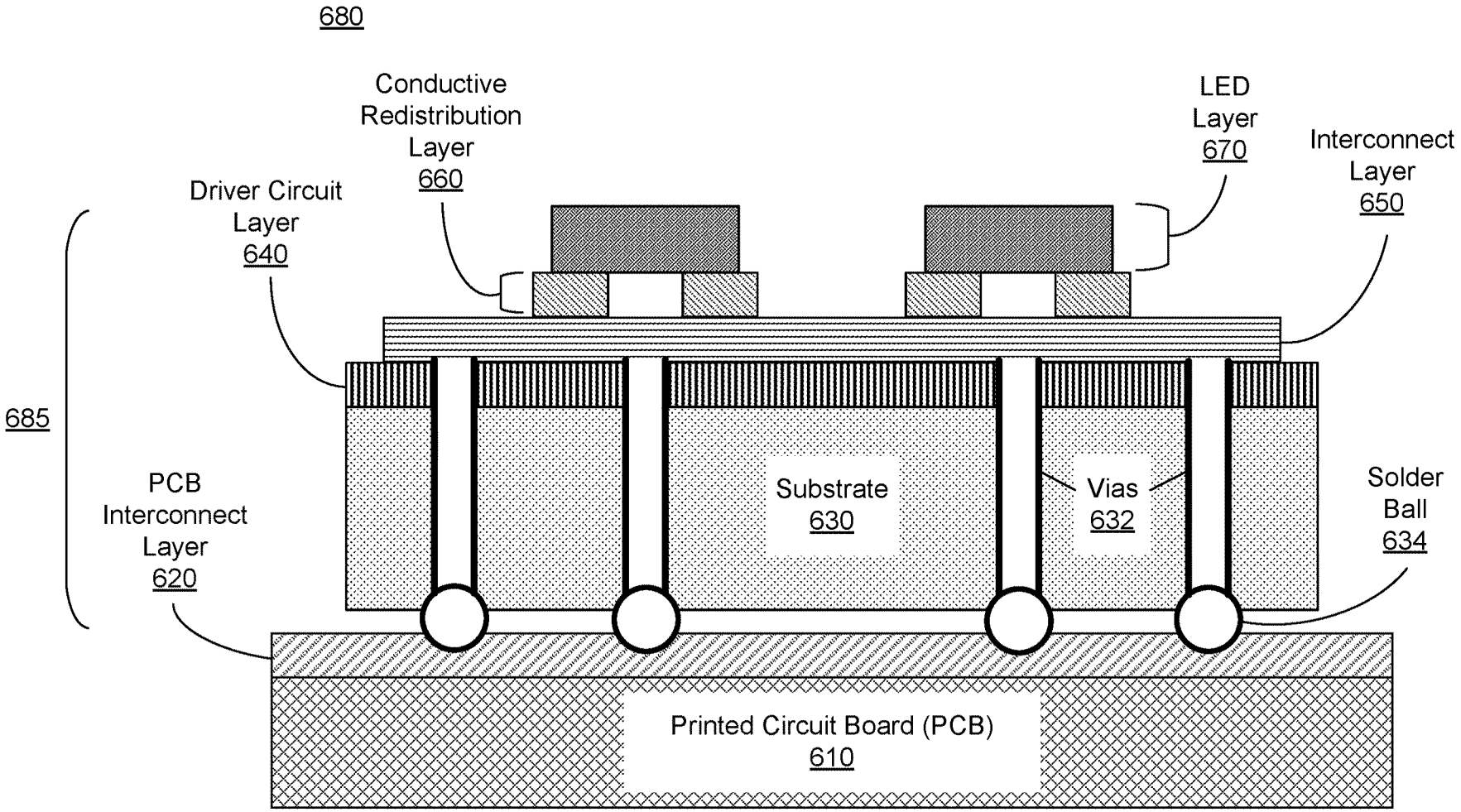
FIG. 6B is a cross sectional view of a second embodiment of an LED and driver circuit that may be utilized in a display device.

FIG. 6B is a cross sectional view of a second embodiment of a display device 680 including an integrated LED and driver circuit 685, according to one embodiment. The display device 680 is substantially similar to the display device 600 described in FIG. 6A but utilizes vias 632 and corresponding connected solder balls 634 to make electrical connections between the driver circuit layer 640 and the PCB 610 instead of the wires 655. Here, the vias 632 are plated vertical electrical connections that pass completely through the substrate layer 630. In one embodiment, the substrate layer 630 is a Si substrate and the through-chip vias 632 are Through Silicon Vias (TSVs). The through-chip vias 632 are etched into and through the substrate layer 630 during fabrication and may be filled with a metal, such as tungsten (W), copper (C), or other conductive material. The solder balls 634 comprise a conductive material that provide an electrical and mechanical connection to the plating of the vias 632 and electrical traces on the PCB interconnect layer 620. In one embodiment, each via 632 provides an electrical connection for providing signals and supply lines to and from the driver circuits 150 and LED zones 140.

Figure 6C:
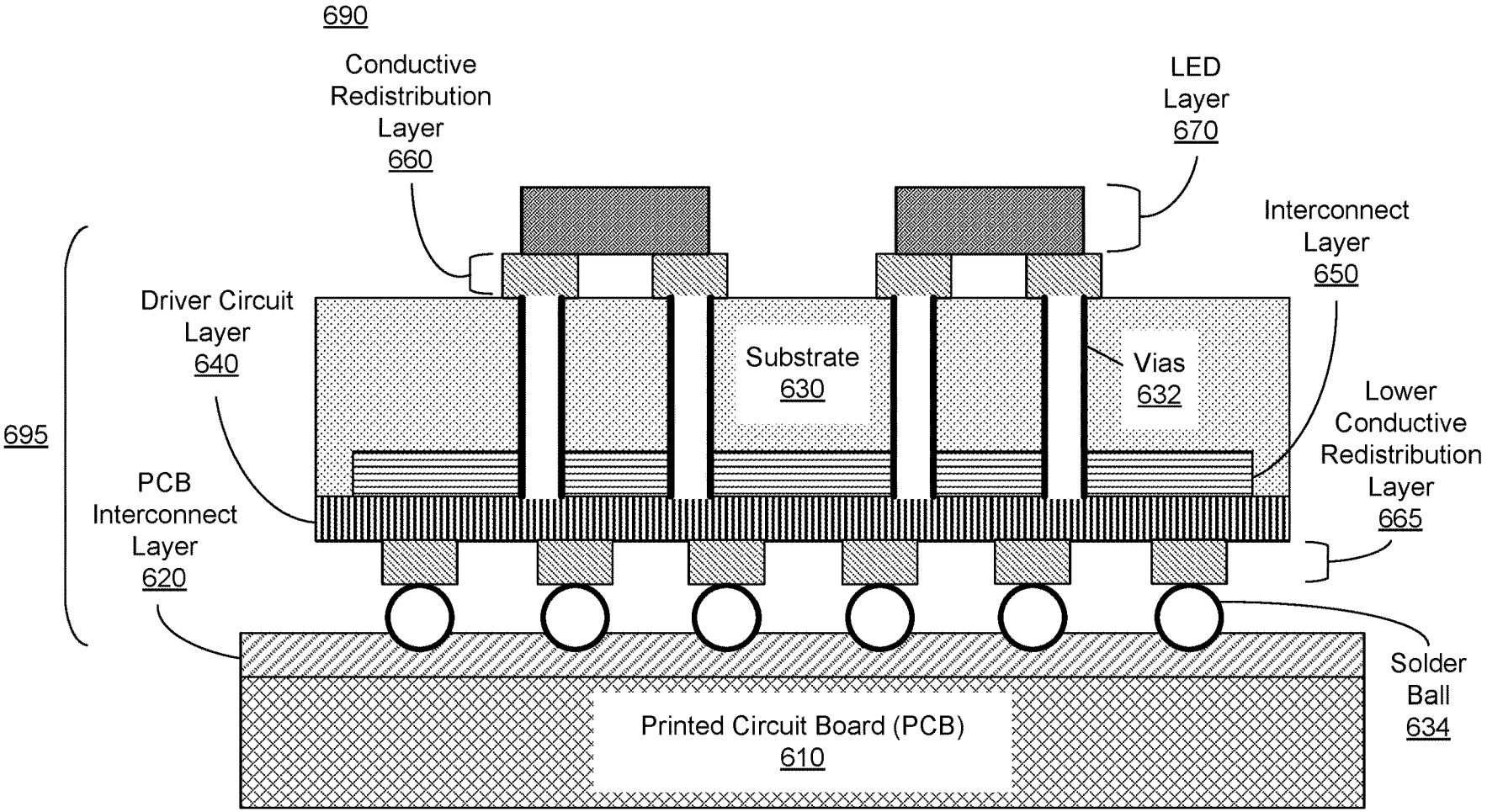
FIG. 6C is a cross sectional view of a third embodiment of an LED and driver circuit that may be utilized in a display device.

FIG. 6C is a cross sectional view of a third embodiment of a display device 690 including an integrated LED and driver circuit 695. The display device 690 is substantially similar to the display device 680 described in FIG. 6B but includes the driver circuit layer 640 and interconnect layer 650 on the opposite side of the substrate 630 from the conductive redistribution layer 660 and the LED layer 670. In this embodiment, the interconnect layer 650 and the driver circuit layer 640 are electrically connected to the PCB 610 via a lower conductive redistribution layer 665 and solder balls 634. The lower conductive redistribution layer 665 and solder balls 634 provide mechanical and electrical connections (e.g., for the driver control signals) between the driver circuit layer 640 and the PCB interconnect layer 620. The driver circuit layer 640 and interconnect layer 650 are electrically connected to the conductive redistribution layer 660 and the LEDs of the LED layer 670 via one or more plated vias 632 through the substrate 630. The one or more vias 632 seen in FIG. 6C may be utilized to provide the signals and supply lines as described above.

In alternative embodiments, the integrated driver and LED circuits 605, 685, 695 may be mounted to a different base such as a glass base instead of the PCB 610.

Figure 7:
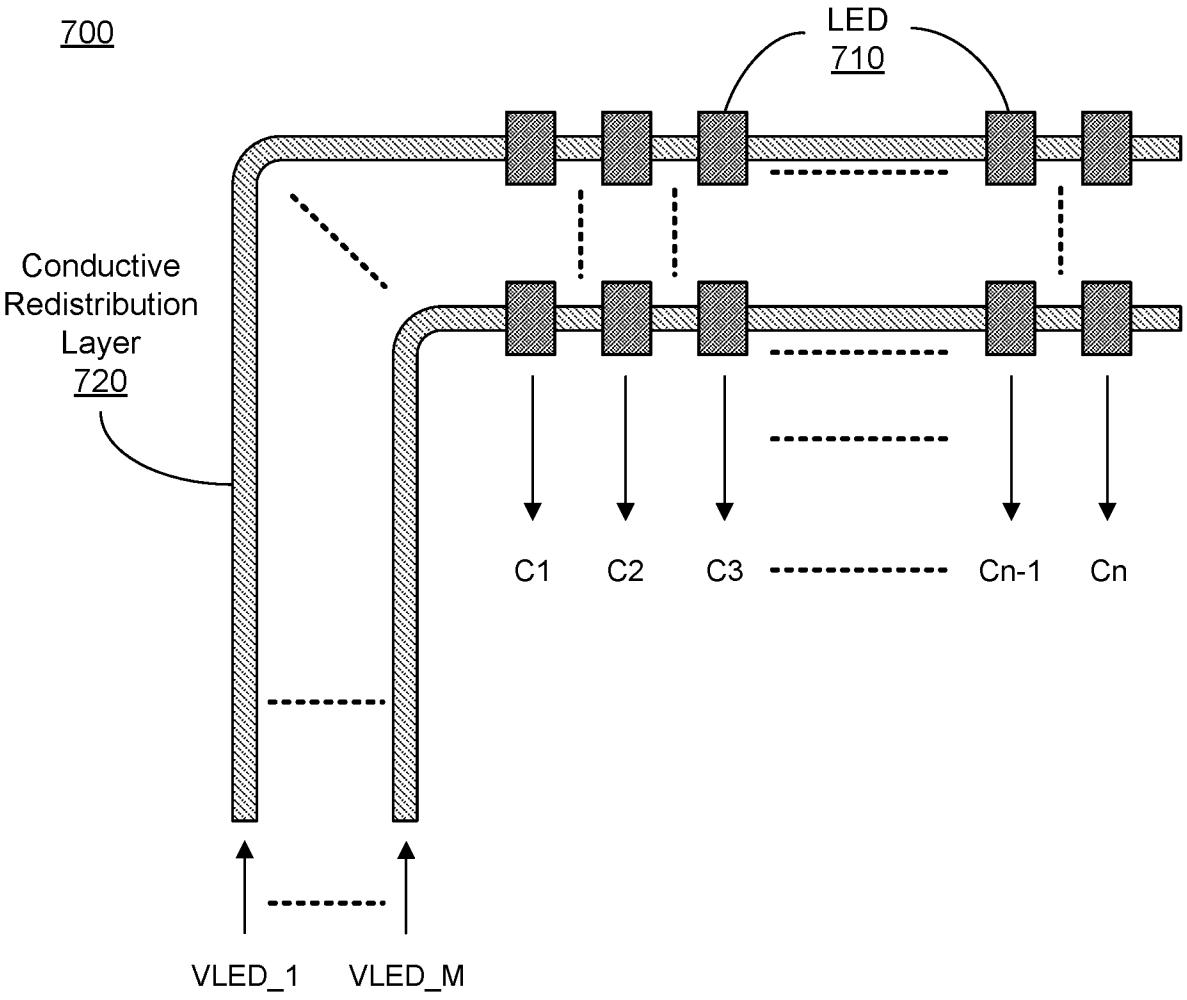
FIG. 7 is a top down view of a display device using an LED and driver circuit, according to one embodiment.

FIG. 7 is a top down view 700 of a display device using an integrated LED and driver circuit, according to one embodiment. The view 700 can correspond to any of the integrated LED and driver circuits 605, 685, 695 depicted in FIGS. 6A-6C. A plurality of LEDs in an LED layer 670 is arranged in rows and columns (e.g., C1, C2, C3, . . . Cn−1, Cn) in FIG. 7. For passive matrix architectures, each row of LEDs of the LED layer 670 is connected by a conductive redistribution layer 660 to a demultiplexer which outputs a plurality of VLED signals (i.e., VLED_1 . . . VLED_M). The VLED signals provide power (i.e., a supply voltage) to a corresponding row of LEDs in the LED layer 670 via the conductive redistribution layer 660.

Figure 8:
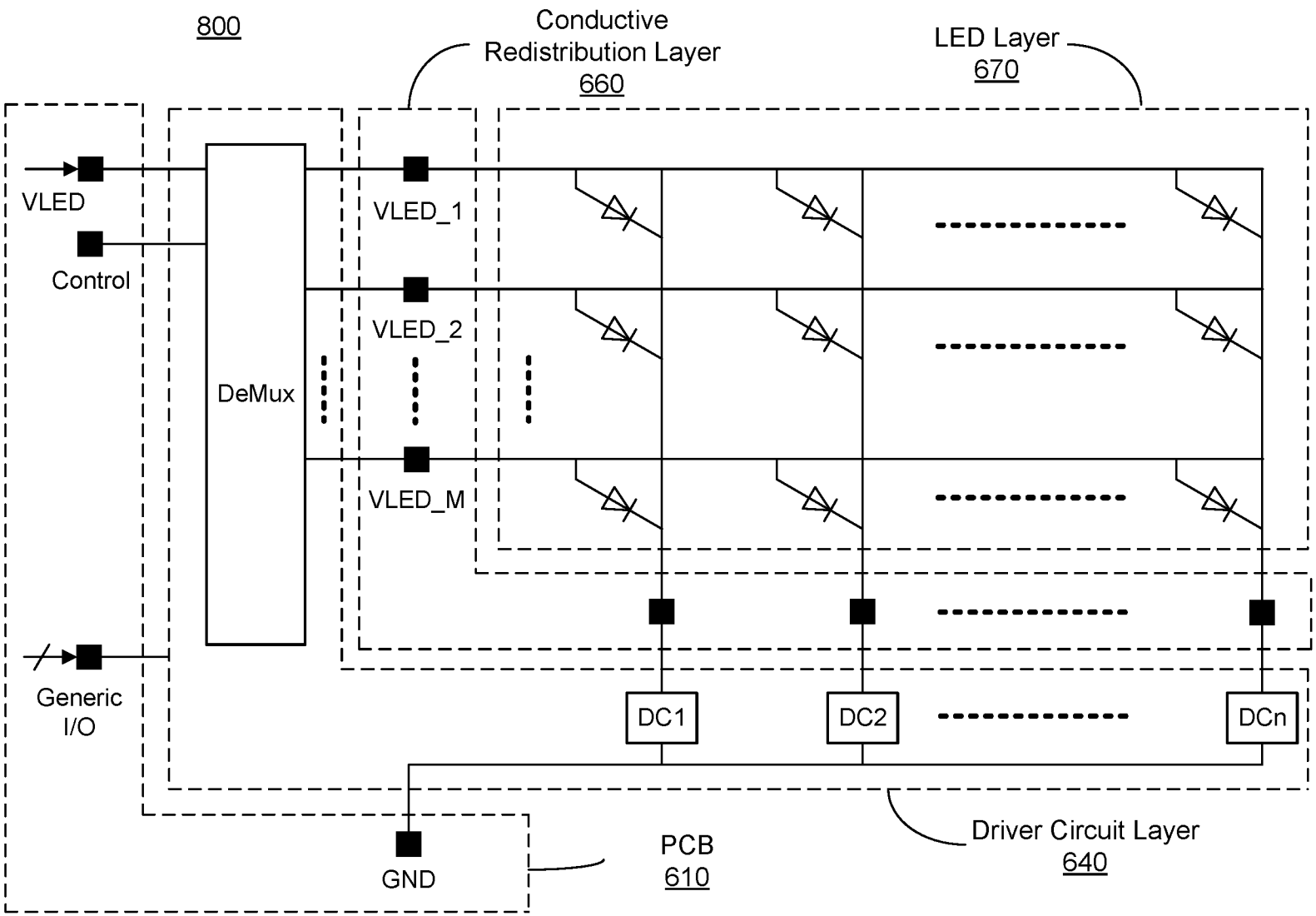
FIG. 8 illustrates a schematic view of several layers of an LED and driver circuit for a display device, according to one embodiment.

FIG. 8 illustrates a schematic view of several layers of a display device 800 with an integrated LED and driver circuit, according to one embodiment. The schematic view includes the PCB 610, the driver circuit layer 640, the conductive redistribution layer 660, and the LED layer 670 as described in FIGS. 6A-6C. The schematic of FIG. 8 shows circuit connections for the circuits 605, 685, 695 of FIGS. 6A-6C but does not reflect the physical layout. As described above, in the physical layout, the LED layer 670 is positioned on top of (i.e., vertically stacked over) the conductive redistribution layer 660. The conductive redistribution layer 660 is positioned on top of the driver circuit layer 640 and the driver circuit layer 640 is positioned on top of the PCB 610.

The PCB 610 includes a connection to a power source supplying power (e.g., VLED) to the LEDs, a control circuit for generating a control signal, generic I/O connections, and a ground (GND) connection. The driver circuit layer 640 includes a plurality of driver circuits (e.g., DC1, DC2, . . . DCn) and a demultiplexer DeMux. The conductive redistribution layer 660 provides electrical connections between the driver circuits and the demultiplexer DeMux in the driver circuit layer 640 to the plurality of LEDs in the LED layer 670. The LED layer 670 includes a plurality of LEDs arranged in rows and columns. In this example implementation, each column of LEDs is electrically connected via the conductive redistribution layer 660 to one driver circuit in the driver circuit layer 640. The electrical connection established between each driver circuit and its respective column of LEDs controls the supply of driver current from the driver circuit to the column. In this embodiment, each diode shown in the LED layer corresponds to an LED zone. Each row of LEDs is electrically connected via the conductive redistribution layer 660 to one output (e.g., VLED_1, VLED_2, . . . VLED_M) of the demultiplexer DeMux in the driver circuit layer 640. The demultiplexer DeMux in the driver circuit layer 640 is connected to a power supply (VLED) and a control signal from the PCB 610. The control signal instructs the demultiplexer DeMux which row or rows of LEDs are to be enabled and supplied with power using the VLED lines. Thus, a particular LED in the LED layer 670 is activated when power (VLED) is supplied on its associated row and the driver current is supplied to its associated column.

Upon reading this disclosure, those of skill in the art will appreciate still additional alternative embodiments through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope described herein.

What is claimed is:

1. A display device, comprising:

an array of light emitting diode zones in a display area of the display device, each of the light emitting diode zones comprising one or more light emitting diodes;

a control circuit to generate dimming signals to control respective duty cycles for driving the light emitting diode zones during a frame; and an array of driver circuits distributed in the display area of the display device, each of the driver circuits to receive the respective duty cycles for the frame at a first time, to receive an update signal at a second time that is after the first time, and to drive one of the light emitting diode zones according to the respective duty cycles of the dimming signals in response to the update signal, wherein a first group of driver circuits start driving first light emitting diode zones from the array of light emitting diode zones at a first offset time responsive to the update signal, and a second group of driver circuits start driving a second group of light emitting diode zones from the array of light emitting diode zones at a second offset time responsive to the update signal, wherein the first offset time and the second offset time are different.

2. The display device of claim 1, wherein the first offset time and the second offset time are determined relative to a start time of the frame.

3. The display device of claim 1, wherein the control circuit is configured to send a first update signal to the first group of driver circuits at the first offset time and a second update signal to the second group of driver circuits at the second offset time to cause driver circuits of the first group of driver circuits to start driving the first light emitting diode zones in response to the first update signal, and to cause driver circuits of the second group of driver circuits to start driving the second light emitting diode zones in response to the second update signal.

4. The display device of claim 1, wherein the driver circuits of the first group of driver circuits are configured to store the first offset time and the driver circuits of the second group of driver circuits are configured to store the second offset time, and wherein the control circuit is configured to send the update signal to the driver circuits of the first group of driver circuits and to the driver circuits of the second group of driver circuits at the second time to cause the driver circuits of the first group of driver circuits to start driving the first light emitting diode zones after the first offset time and to cause the driver circuits of the second group of driver circuits to start driving the second light emitting diode zones after the second offset time.

5. The display device of claim 4, wherein the control circuit is configured to provide the first offset time to the driver circuits of the first group of driver circuits and the second offset time to the driver circuits of the second group of driver circuits during a configuration mode.

6. The display device of claim 1, wherein the driver circuits of the first group of driver circuits are configured to determine the first offset time based at least in part on a first duty cycle of the first group of driver circuits, and the driver circuits of the second group of driver circuits are configured to determine the second offset time based at least in part on a second duty cycle of the second group of driver circuits.

7. The display device of claim 1, wherein at least one of the driver circuits from the first group of driver circuits is configured to determine the first offset time such that a midpoint of an on-time of a duty cycle of the at least one of the driver circuits occurs at a predefined reference time in the frame.

8. The display device of claim 1, wherein at least one of the driver circuits from the first group of driver circuits is configured to determine the first offset time such that a midpoint of an on-time of a duty cycle of the at least one of the driver circuits lags a predefined reference time in the frame by a predefined time period.

9. The display device of claim 1, wherein at least one of the driver circuits from the first group of driver circuits is configured to determine the first offset time such that a midpoint of an on-time of a duty cycle of the at least one of the driver circuits precedes a predefined reference time in the frame by a predefined time period.

10. The display device of claim 1, wherein the first group of driver circuits comprise a first row of driver circuits and the second group of driver circuits comprise a second row of driver circuits that is different from the first row.

11. The display device of claim 1, wherein the first group of driver circuits comprise a first column of driver circuits and the second group of driver circuits comprise a second column of driver circuits that is different from the first column.

12. The display device of claim 1, wherein each of the driver circuits of the first group of driver circuits is configured to store a respective individual offset time, wherein the control circuit is configured to send respective update signals to the first group of driver circuits and the second group of driver circuits at different group offset times, wherein the driver circuits of the first group of driver circuits initiate driving of the respective first light emitting diode zones after their configured individual offset times in response to receiving the update signals.

13. The display device of claim 1, wherein the first offset time and the second offset time are determined to avoid simultaneous turn off of the first light emitting diode zones and the second light emitting diode zones.

14. An integrated light emitting diode and driver circuit for a display device, comprising:

a substrate;

a light emitting diode zone located in a display area of the display device comprising one or more light emitting diodes in a light emitting diode layer over the substrate, the light emitting diodes to generate light in response to a driver current; and a driver circuit over the substrate in a driver circuit layer and integrated in a common package with the light emitting diode zone, the driver circuit to receive a duty cycle for a frame at a first time, to receive an update signal at a second time that is after the first time, and to drive the light emitting diode zone according to the duty cycle in response to the update signal.

15. The integrated light emitting diode and driver circuit of claim 14, wherein the driver circuit is configured to determine an offset time for each frame based on the duty cycle and to control the light emitting diode zone to turn on after the offset time.

16. The integrated light emitting diode and driver circuit of claim 15, wherein the offset time is determined to avoid simultaneous turn off of light emitting diode zones.

17. The integrated light emitting diode and driver circuit of claim 14, wherein the driver circuit is configured to determine an offset time for each frame based on the duty cycle and to control the light emitting diode zone to turn on after the offset time, wherein the offset time is determined such that a midpoint of the light emitting diode zone on-time occurs at a predefined reference time in the frame.

18. The integrated light emitting diode and driver circuit of claim 14, wherein the driver circuit is configured to determine an offset time for each frame based on the duty cycle and to control the light emitting diode zone to turn on after the offset time, wherein the offset time is determined such that a midpoint of the light emitting diode zone on-time lags a predefined reference time in the frame by a predefined time period.

19. The integrated light emitting diode and driver circuit of claim 14, wherein the driver circuit is configured to determine an offset time for each frame based on the duty cycle and to control the light emitting diode zone to turn on after the offset time, wherein the offset time is determined such that a midpoint of the light emitting diode zone on-time precedes a predefined reference time in the frame by a predefined time period.

20. A method for operating a display device, the method comprising:

transmitting, by a control circuit, dimming signals to an array of driver circuits distributed in a display area of the display device at a first time to control respective duty cycles for driving an array of light emitting diode zones in the display area during a frame;

transmitting, by the control circuit, one or more update signals to the driver circuits at a second time that is after the first time;

driving, by the driver circuits distributed in the display area, the respective light emitting diode zones according to the respective duty cycles of the dimming signals in response to the one or more update signals, wherein a first group of driver circuits start driving first light emitting diode zones from the array of light emitting diode zones at a first offset time responsive to the one or more update signals, and a second group of driver circuits start driving a second group of light emitting diode zone from the array of light emitting diode zones at a second offset time responsive to the one or more update signals, wherein the first offset time and the second offset time are different.

* * * * *